US009683767B2

(12) United States Patent
Choi et al.

(10) Patent No.: US 9,683,767 B2
(45) Date of Patent: Jun. 20, 2017

(54) COOLING SYSTEM AND CONTROL METHOD THEREOF

(71) Applicant: LG ELECTRONICS INC., Seoul (KR)

(72) Inventors: Jaeheuk Choi, Seoul (KR); Taehee Kwak, Seoul (KR); Yoonho Yoo, Seoul (KR); Doyong Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 260 days.

(21) Appl. No.: 14/322,297

(22) Filed: Jul. 2, 2014

(65) Prior Publication Data

US 2015/0007598 A1 Jan. 8, 2015

(30) Foreign Application Priority Data

Jul. 2, 2013 (KR) ..... 10-2013-0077016

(51) Int. Cl.
*F25B 41/00* (2006.01)
*F25B 1/10* (2006.01)
(Continued)

(52) U.S. Cl.
CPC ..... *F25B 49/02* (2013.01); *F25B 1/10* (2013.01); *F25B 41/04* (2013.01); *F25B 41/043* (2013.01);
(Continued)

(58) Field of Classification Search
CPC .. F25B 49/02; F25B 1/10; F25B 41/04; F25B 41/043; F25B 2600/2509; F25B 2600/022; F25B 2400/0401; F25B 2400/13
(Continued)

(56) References Cited

U.S. PATENT DOCUMENTS 4,938,029 A * 7/1990 Shaw ..... F25B 1/10 62/117
2009/0158764 A1* 6/2009 Kim ..... F25B 13/00 62/225
(Continued)

FOREIGN PATENT DOCUMENTS

DE 10 2010 026648 A1 1/2012
EP 2 088 388 A1 8/2009

OTHER PUBLICATIONS

European Search Report dated Jan. 15, 2015 issued in Application No. 14 175 401.0.

*Primary Examiner* — Ryan J Walters
*Assistant Examiner* — Joseph Trpisovsky
(74) *Attorney, Agent, or Firm* — KED & Associates, LLP

(57) ABSTRACT

A cooling system and a control method thereof are provided. The cooling system may include a first compressor, a second compressor disposed downstream of the first compressor, an outdoor heat exchanger the performs heat exchange between refrigerant compressed in the first and/or second compressor and external air, an expansion device that decompresses the refrigerant condensed in the outdoor heat exchanger, a cooling evaporator evaporating the refrigerant decompressed in the expansion device, a bypass tube that guides refrigerant compressed in the first compressor to the outdoor heat exchanger, bypassing the second compressor, and a valve device controlling the flow of refrigerant discharged from the first compressor so as to selectively introduce refrigerant into the second compressor.

8 Claims, 7 Drawing Sheets

(51) Int. Cl.

| | |
|---|---|
| ***F25B 1/00*** | (2006.01) |
| ***F25B 5/00*** | (2006.01) |
| ***F25B 49/02*** | (2006.01) |
| ***F25B 41/04*** | (2006.01) |

(52) U.S. Cl.
CPC ... *F25B 2400/0401* (2013.01); *F25B 2400/13* (2013.01); *F25B 2600/022* (2013.01); *F25B 2600/2509* (2013.01)

(58) Field of Classification Search
USPC ..... 62/117, 115, 196.1, 196.2, 510
See application file for complete search history.

(56) References Cited

U.S. PATENT DOCUMENTS

| | | | | |
|---|---|---|---|---|
| 2010/0223939 | A1* | 9/2010 | Mitra | F25B 1/10 62/117 |
| 2013/0104582 | A1* | 5/2013 | Sandkoetter | F25B 1/10 62/196.3 |
| 2013/0104584 | A1* | 5/2013 | Takizawa | F25B 1/10 62/228.1 |

* cited by examiner

COOLING SYSTEM AND CONTROL METHOD THEREOF

CROSS-REFERENCE TO RELATED APPLICATION(S)

This application claims priority under 35 U.S.C. §119 to Korean Application No. 10-2013-0077016 filed on Jul. 2, 2013, whose entire disclosure is hereby incorporated by reference.

BACKGROUND

1. Field

This relates to a cooling system and a control method thereof.

2. Background

Cooling systems may include refrigeration systems and freezing systems. A cooling system may maintain goods in a refrigerated or frozen state in a predetermined space by heat exchange between a refrigerant flowing into a heat exchange cycle and outdoor air and heat exchange between the refrigerant and air within the predetermined space. When the goods are refrigerated in the predetermined space, the cooling system may function as a refrigeration system. On the other hand, when the goods are frozen, the cooling system may function as a freezing system.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments will be described with reference to the accompanying drawings. However, embodiments may have many different forms and should not be construed as being limited to the embodiments set forth herein; rather, alternate embodiments falling within the spirit and scope as broadly described herein will fully convey the concept to those skilled in the art.

Figure 1:
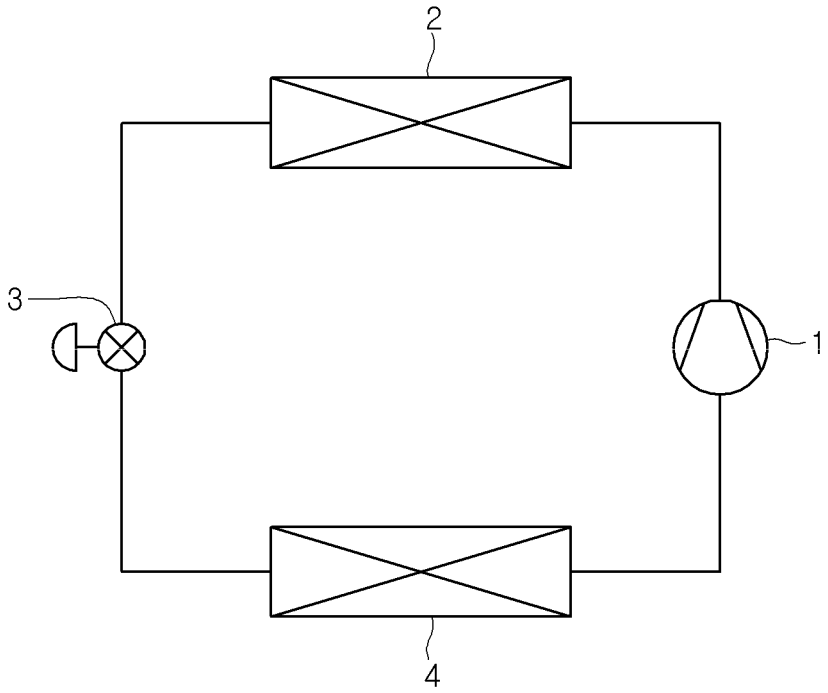
FIG. 1 is a schematic view of an exemplary cooling system.

Referring to FIG. 1, a freezing cycle may operate in a cooling system including a compressor 1 compressing a refrigerant, an outdoor heat exchanger 2 in which the refrigerant and outdoor air are heat-exchanged with each other, an expansion device 3 for decompressing the condensed refrigerant in the outdoor heat exchanger 2, and a cooling evaporator 4 for evaporating the expanded refrigerant. In this arrangement, cool air generated in the cooling evaporator 4 may cool a predetermined space. For example, the predetermined space may be a storage chamber of a refrigerator or freezer, and in particular, a storage chamber of a refrigerator or a freezer that is used in supermarkets or convenience stores, which are used throughout the year, so power consumption may be relatively large. Since the cooling system, particularly, the freezing system has a relatively low evaporation temperature when compared to a general air conditioner (cooling or heating operation), a compression ratio of the compressor may increase in the summer season, when external air temperatures are relatively high. If the compression ratio increases, the refrigerant discharged from the compressor may abnormally increase in temperature, deteriorating operation reliability of the compressor, causing breakdown in the compressor, and increasing power consumption due to increased load applied to the compressor.

Figure 2:
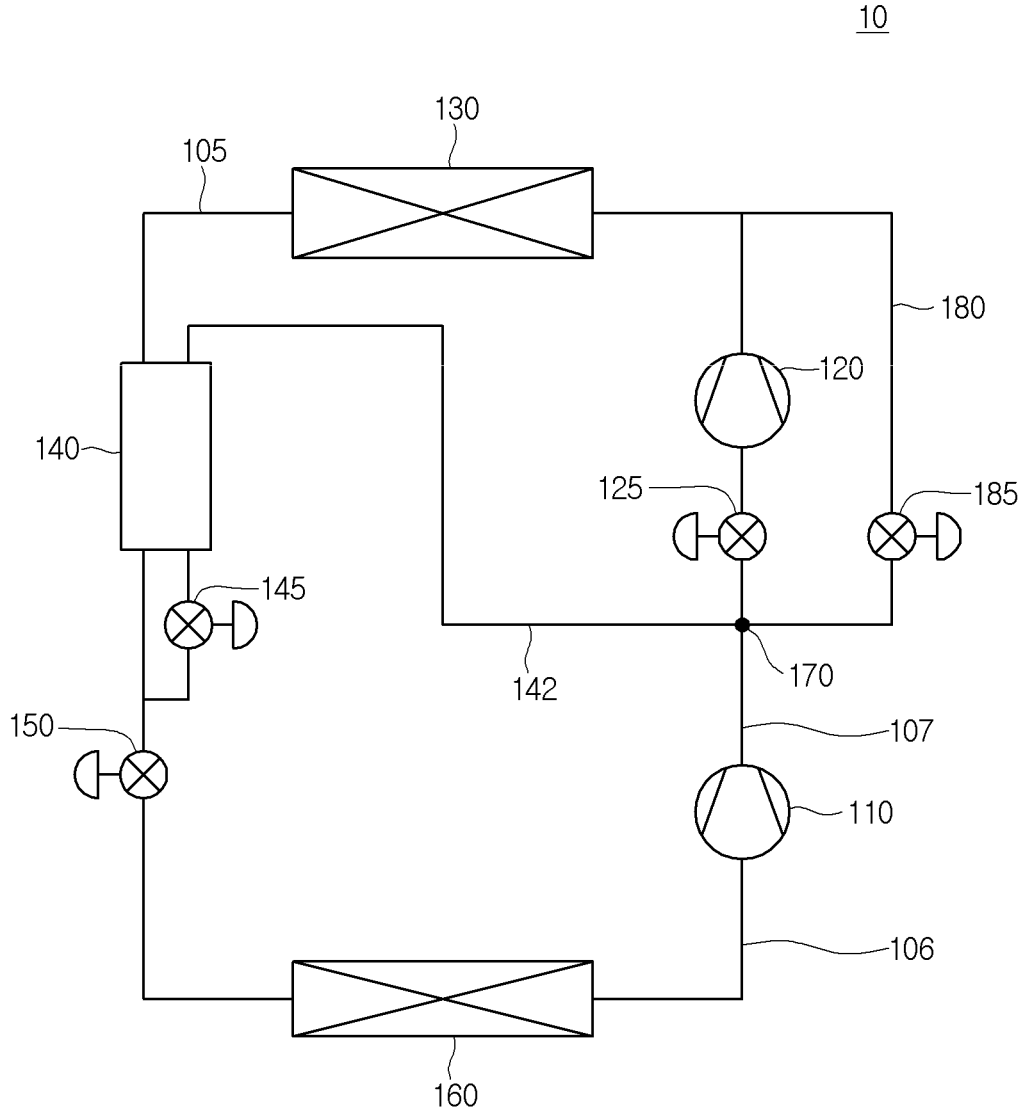
FIG. 2 is a schematic view of a cooling system, according to an embodiment as broadly described herein.
Figure 3:
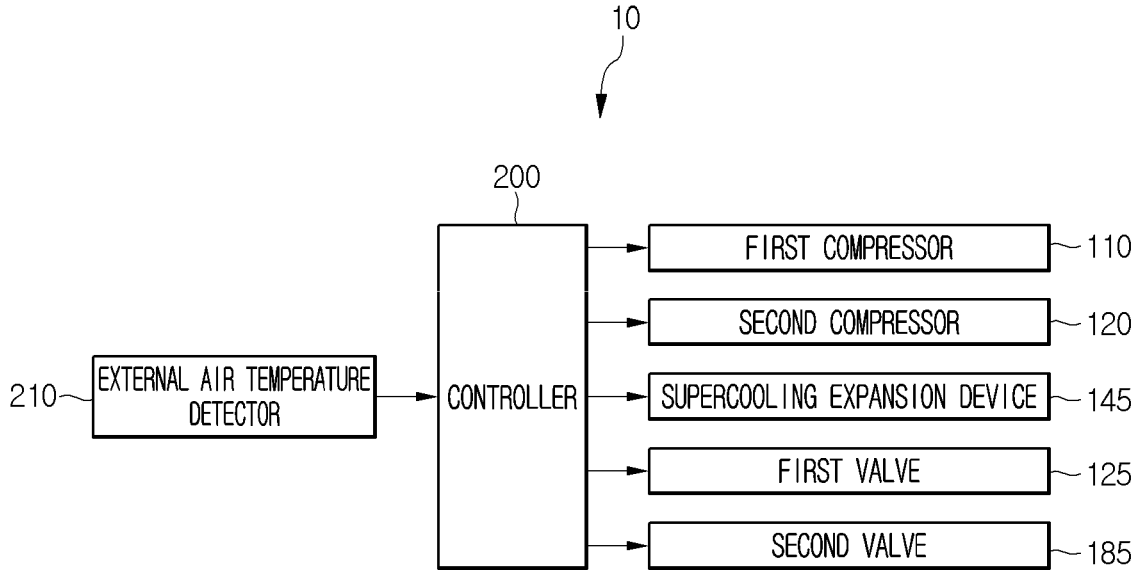
FIG. 3 is a block diagram of a cooling system, according to an embodiment as broadly described herein.

Referring to FIGS. 2 and 3, a cooling system 10 as embodied and broadly described herein may include a plurality of compressors including a first compressor 110 and a second compressor 120, an outdoor heat exchanger 130 for condensing refrigerant compressed in the first and second compressors 110 and 120, a supercooler 140 for further cooling the refrigerant condensed in the outdoor heat exchanger 130, an expansion device 150 for decompressing the refrigerant supercooled in the supercooler 140, and a cooling evaporator 160 for evaporating the refrigerant decompressed in the expansion device 150.

The cooling system 10 may also include a refrigerant tube 105 connecting the components of the cooling system to each other to guide a flow of the refrigerant. The refrigerant tube 105 may include a suction tube 106 for guiding refrigerant into the first compressor 110 and a discharge tube 107 for discharging compressed refrigerant from the first compressor 110.

The first compressor 110 may be connected to the second compressor 120 in series. The discharge tube 107 of the first compressor 110 may extend to a suction part of the second compressor 120. The discharge tube 107 of the first compressor 110 may be considered a "suction tube" of the second compressor 120. The suction tube 106 may be a "first suction tube", and the discharge tube 107 may be a "second suction tube".

The first and second compressors 110 and 120 may be arranged so that refrigerant undergoes one-stage, or primary, compression in the first compressor 110, is suctioned into the second compressor 120 and then undergoes two-stage, or secondary, compression.

The outdoor heat exchanger 130 may be disposed in an outdoor space to allow the refrigerant to be heat-exchanged with external air. A condensation pressure of the freezing cycle, i.e., a refrigerant pressure or temperature in the outdoor heat exchanger 130 may be determined according to the external air temperature. When the external air temperature increases, the condensation pressure in the freezing cycle may increase. On the other hand, when the external air temperature decreases, the condensation pressure in the freezing cycle may decrease.

If the external air temperature increases, a compression ratio of the first or second compressor 110 or 120 increases to correspond to the increasing condensation pressure. Thus, a discharge temperature of the refrigerant in the first or second compressor 110 or 120 may be increased.

The cooling system 10 may also include an injection tube 142 that branches at least a portion of the refrigerant flowing into the refrigerant tube 105 to the supercooler 140. The refrigerant within the injection tube 142 may undergo heat-exchange with refrigerant flowing in the refrigerant tube 105 within the supercooler 140.

The injection tube 142 may guide the refrigerant heat-exchanged in the supercooler 140 toward an inlet of the second compressor 120.

A supercooling expansion device 145 for adjusting a refrigerant flow in the injection tube 142 may be provided in the injection tube 142. For example, the supercooling expansion device 145 may be an electric expansion valve (EEV) having an adjustable opening degree. The refrigerant may be decompressed while passing through the supercooling expansion device 145. A degree of decompression of the refrigerant may vary according to an opening degree of the supercooling expansion device 145.

The refrigerant decompressed in the supercooling expansion device 145 may be introduced into the supercooler 140 and heat-exchanged with the refrigerant flowing in the refrigerant tube 105. In this process, the refrigerant in the refrigerant tube 105 may be additionally cooled to absorb or evaporate the refrigerant in the injection tube 142.

The injection tube 142 may be connected to the discharge tube 107. A tube coupler 170 coupled to the injection tube 142 may be disposed in the discharge tube 107. The tube coupler 170 may be disposed at a point between the first and second compressors 110 and 120, i.e., at an outlet-side of the first compressor 110 or a suction-side of the second compressor 120.

Thus, the refrigerant compressed in the first compressor 110 and flowing into the discharge tube 107 may be mixed with the refrigerant flowing through the injection tube 142 and introduced into the second compressor 120. As described above, the refrigerant passing through the supercooler 140, i.e., the refrigerant having a pressure greater than the evaporation pressure, may be introduced into the second compressor 120 to help the reduction in compression ratio of the compressors 110 and 120.

The cooling evaporator 160 may be disposed on a side of a cooling space that is defined as a storage space for cooling goods. While the refrigerant is evaporated in the cooling evaporator 160, cool air may be generated and supplied into the cooling space. The cooling space may be, for example, a showcase, as previously discussed in a coupling system in a commercial environment.

The refrigerant evaporated in the cooling evaporator 160 may be suctioned into the first compressor 110.

The cooling system 10 may also include a bypass tube 180 allowing the refrigerant compressed in the first compressor 110 to bypass the second compressor 120. The bypass tube 180 may extend from an outlet-side of the first compressor 110 to an outlet-side of the second compressor.

In detail, the bypass tube 180 may extend from the coupler 170 of the discharge tube 107 to an outlet-side tube of the second compressor 120. That is, one end of the bypass tube 180 may be coupled to the tube coupler 170, and the other end of the bypass tube 180 may be coupled to the refrigerant tube 105 provided on the discharge-side of the second compressor 120.

The cooling system may also a first valve 125 provided at the suction-side of the second compressor 120 to adjust a flow of the refrigerant to be suctioned into the second compressor 120 and a second valve 185 provided in the bypass tube 180 to adjust a flow of the refrigerant that will bypass the second compressor 120. That is, the first valve 125 may be installed in the discharge tube 107, and the second valve 185 may be installed in the bypass tube 180. For example, the first valve 125 may be disposed at a point between the tube coupler 170 and the second compressor 120.

Each of the first valve 125 and the second valve 185 may include a solenoid valve in which turn-on/off is adjustable, or an EEV in which an opened degree is adjustable.

Although the first valve 125 is provided in the suction-side tube of the second compressor 120 in FIG. 2, embodiments are not limited thereto. For example, the first valve 125 may be provided in the outlet-side tube of the second compressor 120.

In a case in which each of the first and second valves 125 and 185 include a solenoid valve, when the second valve 185 is turned on or closed, and the first valve 125 is turned on or opened, the refrigerant compressed in the first compressor 110 may be suctioned into the second compressor 120 via the first valve 125 and then additionally compressed.

On the other hand, when the first valve 125 is turned off or closed, and the second valve 185 is turned on or opened, the refrigerant compressed in the first compressor 110 may flow into the bypass tube 180 and the second valve 185 to bypass the second compressor 120.

In a case where each of the first and second valves 125 and 185 include an EEV, when an opened degree of the second valve 185 decreases, and an opened degree of the first valve 125 increases, an amount of refrigerant suctioned into the second compressor 120 via the first valve 125 in the refrigerant compressed in the first compressor 110 may increase, and an amount of refrigerant passing through the second valve 185 may decrease.

On the other hand, when the opened degree of the first valve 125 decreases, and the opened degree of the second valve 185 increases, an amount of refrigerant suctioned into the second compressor 120 via the first valve 125 in the refrigerant compressed in the first compressor 110 may decrease, and an amount of refrigerant passing through the second valve 185 may increase.

The cooling system 10 may also include an external air temperature detector 210 for detecting a temperature of external air and a controller 200 for controlling operations of the first and second compressors 110 and 120, the supercooling expansion device 145, and/or the first and second valves 125 and 185 based on the temperature detected by the external air temperature detector 210. The external air temperature detector 210 may include, for example, a temperature sensor.

If it is determined that the temperature detected by the external air temperature detector 210 is below a preset temperature, it may be determined that a high pressure, i.e., the condensation pressure in the cooling system, is below a preset pressure. Thus, since a low pressure, i.e., a pressure difference between the evaporation pressure and the condensation pressure in the cooling cycle is not large, a compression load of the compressor may be within a normal operation range. In this case, the system may be controller so that only the first compressor 110 operates to perform one-stage compression of the refrigerant, thereby improving operation efficiency and reducing power consumption in the system.

On the other hand, if it is determined that the temperature detected by the external air temperature detector 210 is above the preset temperature, it may be determined that a high pressure, i.e., the condensation pressure in the cooling system, is above the preset pressure. Thus, the pressure difference between the evaporation pressure and the condensation pressure may increase, excessively increasing the compression load of the compressor. In this case, the system may be controller so that both the first and second compressors 110,120 operate to perform two-stage compression of the refrigerant, thereby improving operational reliability in the compressor and operational efficiency in the system.

Hereinafter, a method for controlling the cooling system will be described with reference to the accompanying drawings.

Figure 4:
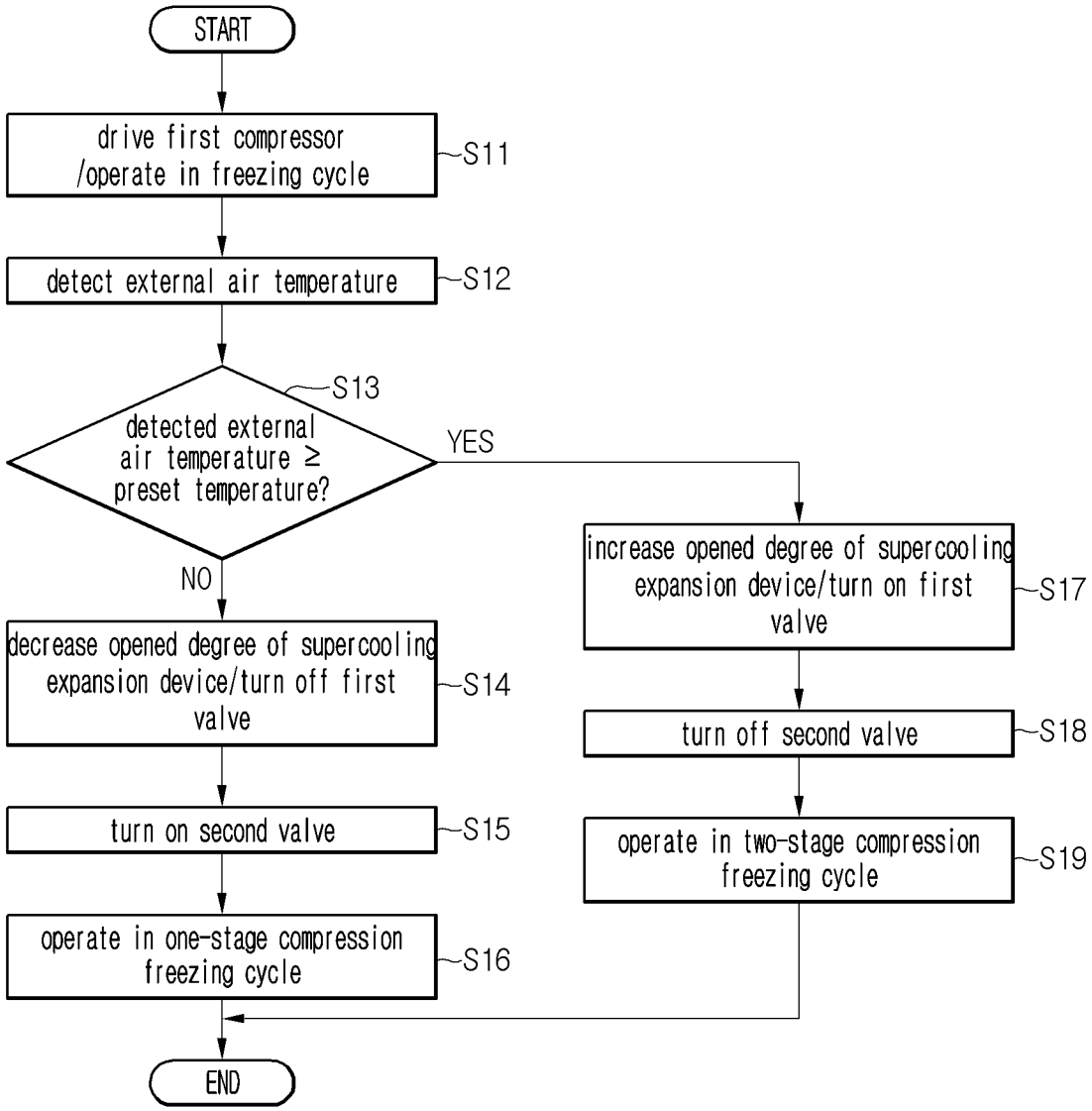
FIG. 4 is a flowchart of a method for controlling the cooling system shown in FIGS. 2 and 3, according to an embodiment as broadly described herein.
Figure 5:
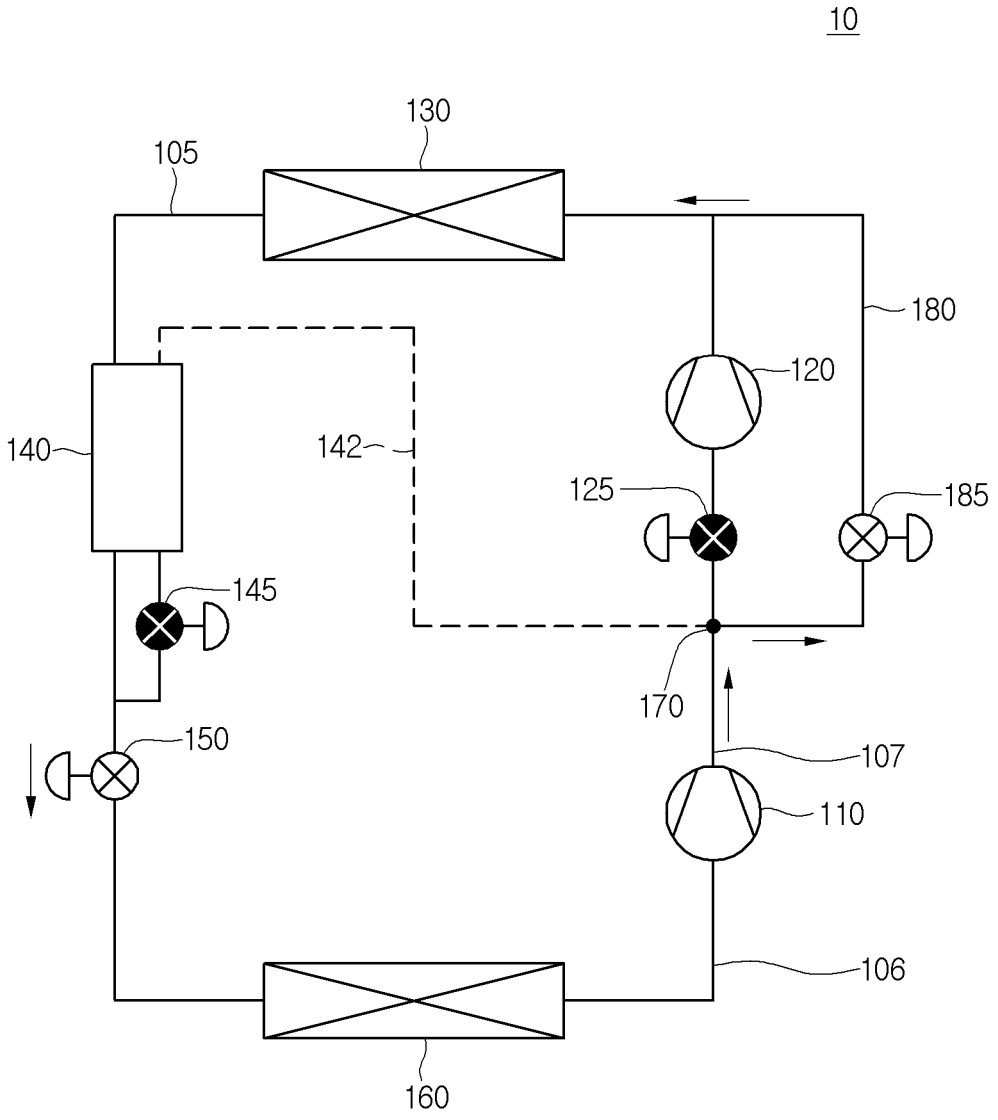
FIG. 5 is a schematic view of a one-stage compression state of the cooling system shown in FIGS. 2 and 3, according to an embodiment as broadly described herein.
Figure 6:
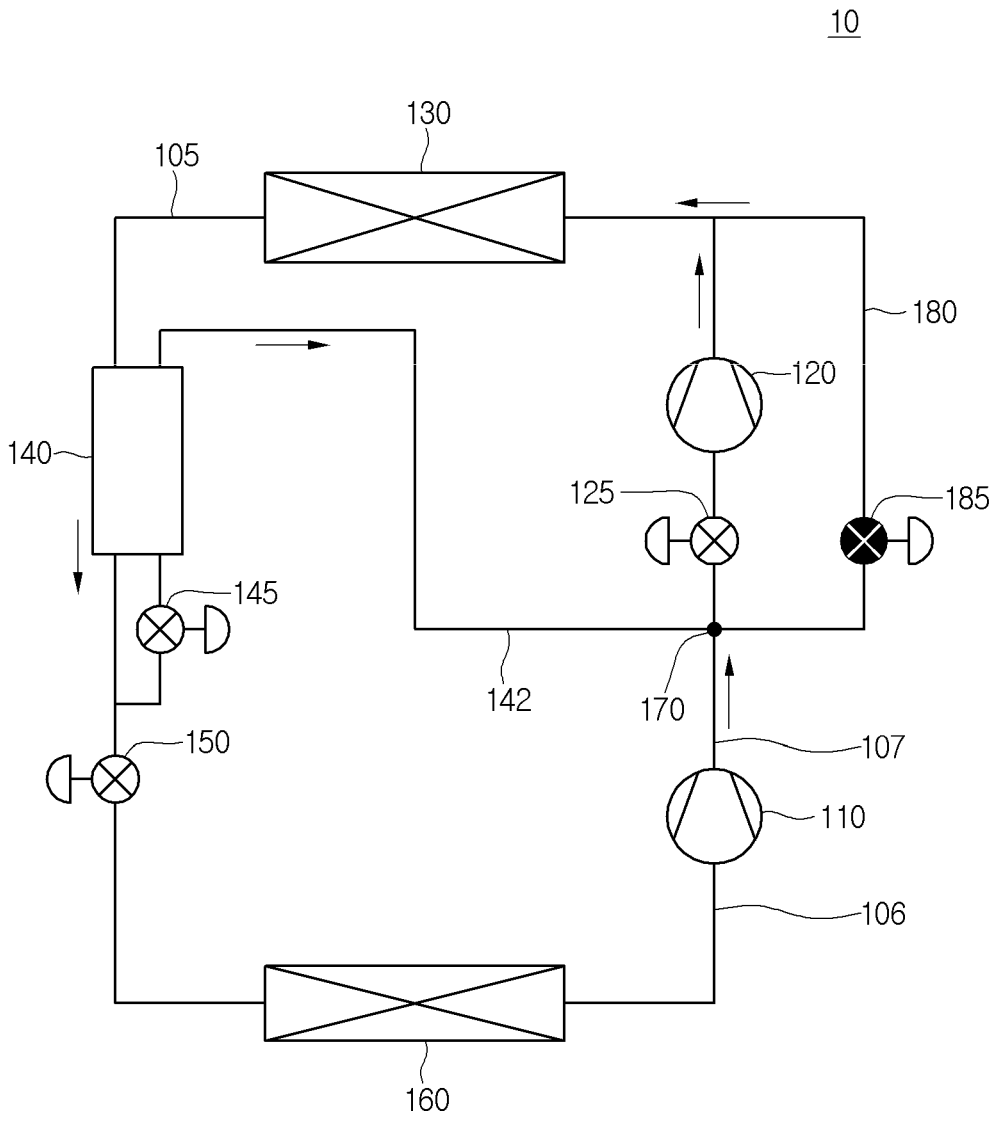
FIG. 6 is a schematic view of a two-stage compression state of the cooling system shown in FIGS. 2 and 3, according to an embodiment as broadly described herein.

FIG. 4 is a flowchart of a method for controlling the cooling system according to an embodiment, FIG. 5 is a schematic view of a one-stage compression state of the cooling system according to an embodiment, and FIG. 6 is a schematic view of a two-stage compression state of the cooling system according to an embodiment.

As shown in FIG. 4, a first compressor 110 may be turned on to operate, with a supercooling expansion device 145 and a first valve 125 turned off, and a second valve 185 maintained in a turn-on state.

Thus, a refrigerant may be compressed in one stage, in which the refrigerant is compressed in only the first compressor 110, but not compressed in the second compressor 120, and may then be circulated into a cooling cycle. That is, the cooling cycle in which the one stage compression is performed may be understood to be a basic cycle in the cooling system according to the current embodiment (S11).

While the cooling system 10 operates, an external air temperature detector 210 may detect a temperature of external air (S12), an the system may determine whether the detected external air temperature is above a preset temperature (S13). For example, the preset temperature may be set to a temperature of about 25° C., taking into consideration it being the summer season or winter season (see FIG. 7). However, this is merely exemplary and, the preset temperature may be set to different temperatures.

When it is determined that the external air temperature is above the preset temperature, it may be determined that the compression load of the compressor has increased/will increase. On the other hand, when it is determined that the external air temperature is below the preset temperature, it may be determined that the cooling cycle may operate using one compressor (S12 and S13).

When it is determined that the external air temperature is below the preset temperature, the system may circulate the refrigerant as illustrated in FIG. 5, i.e., in the one-stage compression cooling cycle.

In detail, the first valve 125 may be turned off, and the second valve 185 may be turned on. Thus, the refrigerant compressed in the first compressor 110 may flow into the bypass tube 180. That is, the suction of the refrigerant into the second compressor 120 may be restricted so that the refrigerant flows into the bypass tube 180, and bypass the second compressor 120.

Also, an opened degree of the supercooling expansion device 145 may decrease to restrict the refrigerant flow into the injection tube 142. Thus, heat exchange between the refrigerant in the supercooler 140 does not occur.

As described above, the refrigerant may undergo one-stage compression in the first compressor 110, but the refrigerant may not be injected into the second compressor 120 through the injection tube 142 (S14, S15, and S16).

On the other hand, when it is determined that the external air temperature is above the preset temperature, the system may circulate the refrigerant as illustrated in FIG. 6, i.e., in the two-stage compression cooling cycle.

In detail, the second valve device 185 may be turned off, and the first valve 125 may be turned on (S17, S18). Thus, the refrigerant compressed in the first compressor 110 may be suctioned into the second compressor 120 and then compressed in two stages. That is, the refrigerant does not flow into the bypass tube 180, but flows into the second compressor 120 for second state compression (S19).

Also, the opened degree of the supercooling expansion device 145 may be increased to allow the refrigerant to flow into the injection tube 142 for heat-exchange with the refrigerant flowing in the refrigerant tube 105 in the supercooler 140, and may then be injected into the second compressor 120 to reduce the compression load.

As described above, the refrigerant may be two-stage compressed in the first and second compressors 110 and 120 and then injected into the second compressor 120 through the injection tube 142, thereby preventing a high compression ratio from occurring in the first compressor 110 (S17, S18, and S19).

Figure 7:
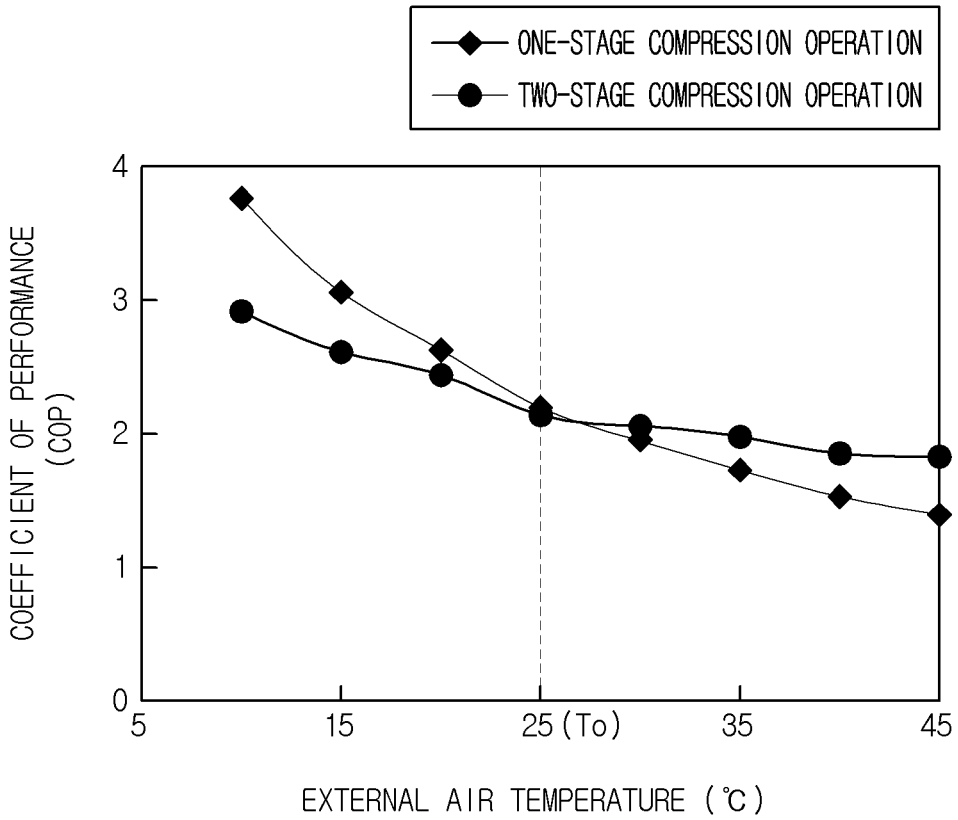
FIG. 7 is a graph of a variation in coefficient of performance according to an external air temperature when one-stage compression and the two-stage compression are performed in a cooling system as embodied and broadly described herein.

FIG. 7 is a graph of a variation in coefficient of performance according to an external air temperature when one-stage compression and two-stage compression are performed in the cooling system, according to an embodiment as broadly described herein.

Referring to FIG. 7, a variation in coefficient of performance (COP) according to an external air temperature when one-stage and two-stage compression is performed is illustrated. The COP may be defined as thermal efficiency in the cooling system. Thermal efficiency in the cooling system may be improved when the COP increases.

In the cooling cycle according to the current embodiment, whether one-stage or two-stage compression is performed may be determined based on a preset temperature T0. For example, the preset temperature T0 may be about 25° C. However, as described above, the preset temperature may be set to different temperatures.

As illustrated in FIG. 7, if the external air temperature is below the preset temperature T0, i.e., is not relatively high, the COP of the cooling cycle when one-stage compression is performed may be greater than that when two-stage compression is performed. Thus, as illustrated in FIG. 5, the cooling cycle may operate in the one-stage compression freezing cycle.

On the other hand, if the external air temperature is above the preset temperature T0, i.e., is relatively high, the COP of the cooling cycle when two-stage compression is performed may be greater than that when one-stage compression is performed. Thus, as illustrated in FIG. 6, the cooling cycle may operate in the two-stage compression freezing cycle.

As described above, since the plurality of compressors are provided in the cooling cycle according to the current embodiment, and one-stage compression or two-stage compression is selectively performed according to whether the external air temperature is above the preset temperature, the operational reliability of the compressor may be improved, and also the COP of the cooling system may be improved.

FIG. 4 illustrates the case in which each of the first and second valve devices 125 and 185 includes the valve of which turn-on/off is adjustable.

However, unlike this, if each of the first and second valves 125 and 185 include a valve in which an open degree is adjustable, an open degree of the first valve 125 may decrease in operation S14, and an open degree of the second valve 185 may increase in operation S15. In this case, most of the refrigerant compressed in the first compressor 110 may substantially flow into the bypass tube 180.

Similarly, an open degree of the first valve 125 may increase in operation S17, and an open degree of the second valve 185 may decrease in operation S18. In this case, most of the refrigerant compressed in the first compressor 110 may be substantially suctioned into the second compressor 120 and then additionally compressed.

According to embodiments as broadly described herein, one-stage compression or two-stage compression may be selectively performed according to the external air temperature to improve the COP of the cooling cycle.

Particularly, in the winter season in which an external air temperature is relatively low, the compressor may operate at a low compression ratio to perform only one-stage compression, thereby improving the efficiency of the system.

On the other hand, in the summer season in which an external air temperature is relatively high, i.e., the compressor operates at a high compression ratio, and two-stage compression may be performed to prevent the compressor from operating at a high compression ratio, thereby improving the efficiency of the system.

Also, since the two compressors operate at the same time, dividing the compression ratio of the compressors, abnormal increases in refrigerant discharge temperature may be restricted, improving the reliability of the compressor.

Embodiments provide a cooling system and a control method thereof that stably operates according to an external air temperature.

In one embodiment, a cooling system as broadly described herein may include a first compressor compressing a refrigerant to cool a set space; a second compressor disposed on an outlet-side of the first compressor; an outdoor heat exchanger in which the refrigerant compressed in the first or second compressor is heat-exchanged with external air; an expansion device decompressing the refrigerant condensed in the outdoor heat exchanger; a cooling evaporator evaporating the refrigerant decompressed in the expansion device to supply cool air into the set space; a bypass tube allowing the refrigerant compressed in the first compressor to bypass the second compressor; and a valve device controlling the refrigerant discharged from the first compressor to allow the refrigerant to be selectively introduced into the second compressor.

The first and second compressors may be connected to each other in series.

The cooling system may also include a discharge tube guiding the discharge of the refrigerant compressed in the first compressor, the discharge tube extending to a suction part of the second compressor, wherein the bypass tube may extend from the discharge tube to a discharge-side of the second compressor.

The cooling system may also include an injection tube in which the refrigerant passing through the outdoor heat exchanger is branched to flow; a supercooling expansion device decompressing the refrigerant flowing into the injection tube; and a supercooler in which the refrigerant passing through the outdoor heat exchanger and the refrigerant flowing into the injection tube are heat-exchanged with each other.

The discharge tube may include a tube coupling part to which the injection tube is connected.

The valve device may include a first valve device opened to introduce the refrigerant flowing into the injection tube into the second compressor; and a second valve device opened to allow the refrigerant discharged from the first compressor to bypass the second compressor.

The valve device may include a first valve device installed in the discharge tube; and a second valve device installed in the bypass tube.

The first valve device may be installed at one point between the tube coupling part and the suction part of the second compressor.

The cooling system may also include an external air temperature detection unit detecting a temperature of the external air; and a control unit controlling a turn-on/off or opened degree of the valve device according to temperature information detected by the external air temperature detection unit.

The control unit may control the first and second valve devices and the supercooling expansion device so that the first valve device and the supercooling expansion device are opened or increase in opened degree, and the second valve device is closed or decrease in opened degree when a temperature detected by the external air temperature detection unit is above a preset temperature.

The control unit may control the first and second valve devices and the supercooling expansion device so that the first valve device and the supercooling expansion device are closed or decrease in opened degree, and the second valve device is opened or increase in opened degree when a temperature detected by the external air temperature detection unit is below a preset temperature.

Each of the first and second valve devices may include a solenoid valve.

Each of the first and second valve devices may include an electronic expansion valve.

In another embodiment, a method for controlling a cooling system including a compressor, an outdoor heat exchanger, and a cooling evaporator, as broadly described herein, may include driving a first compressor to allow the cooling system to operate in a freezing cycle; detecting a temperature of external air; and introducing a refrigerant compressed in the first compressor into a second compressor when the external air temperature is above a preset temperature, and allowing the refrigerant compressed in the first compressor to be bypassed to an outlet-side of the second compressor when the external air temperature is below the preset temperature.

The cooling system may also include a supercooler through which a branched refrigerant heat-exchanged in the outdoor heat exchanger passes, and when the external air temperature is above the preset temperature, the refrigerant passing through the supercooler may be mixed with the refrigerant compressed in the first compressor.

When the external air temperature is above the preset temperature, the mixed refrigerant may be introduced into the second compressor.

The cooling system may also include a bypass tube for allow the refrigerant to be bypassed from an inlet-side to an outlet-side of the second compressor.

When the external air temperature is below the preset temperature, the refrigerant compressed in the first compressor may flow into the bypass tube.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooling system, comprising:

a first compressor that compresses refrigerant;

a second compressor positioned at a discharge side of the first compressor;

an outdoor heat exchanger that receives refrigerant compressed in at least one of the first compressor or the second compressor and preforms heat-exchange of the compressed refrigerant with external air;

an expansion device that receives refrigerant condensed in the outdoor heat exchanger and decompresses the condensed refrigerant;

a cooling evaporator that receives decompressed from the expansion device and evaporates the decompressed refrigerant to supply cool air to a predetermined space;

an injection tube branched from a discharge side of the outdoor heat exchanger, wherein refrigerant that has passed through the outdoor heat exchanger flows into the injection tube;

a discharge tube extending to an inlet of the second compressor from an outlet of the first compressor to guide the discharge of the refrigerant compressed in the first compressor, the discharge tube including a tube coupling part to which the injection tube is connected;

bypass tube extending from the tube coupling part to a discharge side of the second compressor, that guides refrigerant compressed in the first compressor to the outdoor heat exchanger, bypassing the second compressor;

a first valve installed at the discharge tube between the tube coupling part and the inlet of the second compressor, the first valve being configured to open to introduce the refrigerant from the injection tube into the second compressor; and a second valve device installed at the bypass tube, the second valve being configured to open to allow the refrigerant discharged from first compressor to bypass the second compressor.

2. The cooling system of claim 1, wherein the first and second compressors are connected to each other in series.

3. The cooling system of claim 1, further comprising:

a supercooling expansion device that decompresses refrigerant flowing into the injection tube; and a supercooler that performs heat exchange between refrigerant that has passed through the outdoor heat exchanger and refrigerant flowing in the injection tube after passing through the supercooling expansion device.

4. The cooling system of claim 1, further comprising:

an external air temperature detector configured to detect an external air temperature; and a controller configured to control an on/off state or a degree of opening of the valve device based on temperature information detected by the external air temperature detector.

5. The cooling system of claim 4, wherein the controller is configured to open the first valve and the supercooling expansion device or increase a degree of opening of the first valve and the supercooling expansion device, and to close the second valve or to decrease a degree of opening of the second valve, when a temperature detected by the external air temperature detector is greater than or equal to a preset temperature.

6. The cooling system of claim 4, wherein the controller is configured to close the first valve and the supercooling expansion device or to decrease a degree of opening of the first valve and the supercooling expansion device, and to open the second valve or increase a degree of opening of the second valve, when a temperature detected by the external air temperature detector is less than a preset temperature.

7. The cooling system of claim 1, wherein at least one of the first valve or the second valve comprises a solenoid valve.

8. The cooling system of claim 1, wherein at least one of the first valve or the second valve comprises an electronic expansion valve.

* * * * *